United States Patent [19]

Muller

[11] 3,977,565

[45] Aug. 31, 1976

[54] DISPENSER PACKAGE

[75] Inventor: Hermann Müller, Munich, Germany

[73] Assignee: AGFA-Gevaert, A.G., Leverkusen, Germany

[22] Filed: Nov. 25, 1974

[21] Appl. No.: 527,162

[30] Foreign Application Priority Data

Nov. 30, 1973 Germany ..... 2359853

[52] U.S. Cl. ..... 221/63; 206/44.12; 206/73; 221/33; 312/50; 312/60; 312/193

[51] Int. Cl.[2] ..... B65D 73/02; B65D 83/08; B65H 1/04; B65H 9/14

[58] Field of Search ..... 206/73, 39.5, 39.6, 206/39.7, 352, 353, 44 B, 44.12, 73, 425; 221/63, 312, 26, 33, 63, 69, 87; 312/50, 60, 193

[56] References Cited

UNITED STATES PATENTS

| | | | |
|---|---|---|---|
| 846,741 | 3/1907 | Fraser | 312/50 |
| 1,043,854 | 11/1912 | Luellen | 221/63 |
| 1,891,542 | 12/1932 | Huff | 221/63 |
| 2,558,920 | 7/1951 | Baggs | 221/63 |
| 2,816,376 | 12/1957 | Hirvonen | 206/73 |
| 3,069,048 | 12/1962 | Easton et al. | 221/63 X |
| 3,164,298 | 1/1965 | Repko | 206/44.12 UX |
| 3,187,889 | 6/1965 | Sinclair | 206/73 |
| 3,232,478 | 2/1966 | Thomasma et al. | 221/33 |
| 3,260,357 | 7/1966 | Sparks | 206/73 |
| 3,679,096 | 7/1972 | Musser | 221/63 X |

FOREIGN PATENTS OR APPLICATIONS

| | | | |
|---|---|---|---|
| 1,207,592 | 10/1970 | United Kingdom | 206/73 |

*Primary Examiner*—Paul R. Gilliam
*Assistant Examiner*—Carl F. Pietruszka
*Attorney, Agent, or Firm*—Michael J. Striker

[57] ABSTRACT

A container has an end wall and a stack of assemblies each composed of an adhesive film splice and a protective cover for the same, is accommodated in the container. The container has an opening in its end wall of a width which corresponds to the width of the assemblies so that the latter can be withdrawn individually from the container.

6 Claims, 5 Drawing Figures

DISPENSER PACKAGE

BACKGROUND OF THE INVENTION

The present invention relates to a dispenser package in general, and advantageously to a dispenser package which dispenses assemblies composed of a film splice with a protective cover for the same.

Film splices are strips of synthetic plastic material or the like which are provided on one side with a layer of adhesive. The splice is placed over two ends of two pieces of film, for instance where a film strip has broken, and connects the two ends together. While these splices are stored, their adhesive material must be protected by providing a protective cover around the splice. It is known from the prior art to provide a dispenser package for such splices wherein a plurality of such splices are joined together to form a long, folded strip, the joining being the result of web portions of the protective covers which connect these covers. The folded strip is accommodated in a bag or envelope. The difficulty with this type of arrangement is that each film splice with its associated protective cover must be torn off from the remainder of the strip before it can be used. In many instances the cover will readily become detached from the film splice, or versa versa, and in this prior-art arrangement this may lead to premature exposure of the adhesive material on the film splice as the splice with its cover is being detached from the remainder of the strip. In most instances, this will make it impossible for the splice subsequently to be used for splicing together two ends of film strips. Moreover, this prior-art package does not offer the desired ease of dispensing because it requires both hands to detach one of the assemblies from the remainder of the strip.

SUMMARY OF THE INVENTION

Accordingly, it is a general object of this invention to provide an improved dispenser package which avoids the aforementioned disadvantages.

More particularly, it is an object of the invention to provide an improved dispenser package for dispensing adhesive film splices, which permits dispensing of the splices individually and with the use of only one hand.

A further object of the invention is to provide such a dispenser package from which the splices can be dispensed singly and without any danger that they might become detached from their protective cover.

In keeping with these objects, and with others which will become apparent hereafter, one feature of the invention resides in a dispenser package which, briefly stated, comprises a container having an end wall, a stack of objects in the container and having a predetermined width, and an opening in the end wall of a width corresponding to the predetermined width, so as to permit withdrawal of the objects from the container. The objects are advantageously film splices each of which forms with its associated protective cover an assembly. The protective cover may be of paper or the like and advantageously is provided with portions which engage abutment portions that are formed on the container at the opening, so as to prevent unintentional sliding or falling out of the assemblies. A frame is preferably provided in the region of the upper wall of the container to hold the stack, and is provided with an opening through which a user may insert a finger to contact the uppermost assembly of the stack to move it out through the opening in the end wall of the container.

It is also advantageous if the container is provided with mounting means for mounting it at a location where it is required to dispense its contents, for example on a film press wherein film ends are to be united by means of the splices obtained from the container. Such mounting means may be in form of a layer of adhesive provided on at least one outer surface of the container and protected with a peel-off layer until the time of use, or it may be in form of projections or recesses on the container which cooperate with corresponding recesses or projections on the film press or the like.

The novel features which are considered as characteristic for the invention are set forth in particular in the appended claims. The invention itself, however, both as to its method of operation, together with additional objects and advantages thereof, will be best understood from the following description of specific embodiments when read in connection with the accompanying drawing.

DESCRIPTION OF THE PREFERRED EMBODIMENTS

Figure 1:
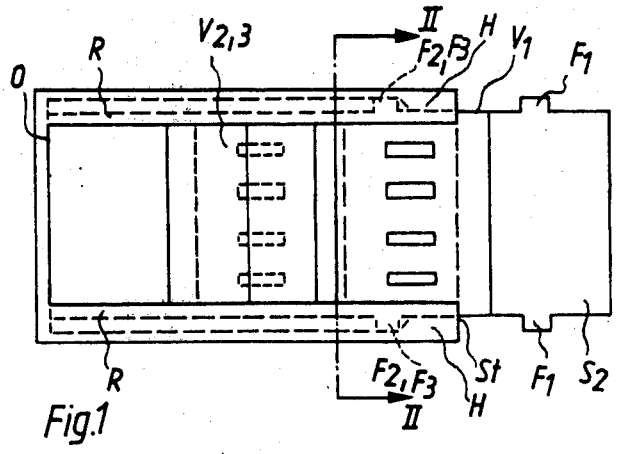
FIG. 1 is a top-plan view in somewhat diagrammatic form illustrating a package according to the present invention with one of the assemblies partially removed from it.
Figure 2:
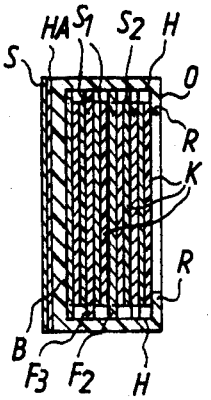
FIG. 2 is a section taken on line II—II of FIG. 1.
Figure 3:
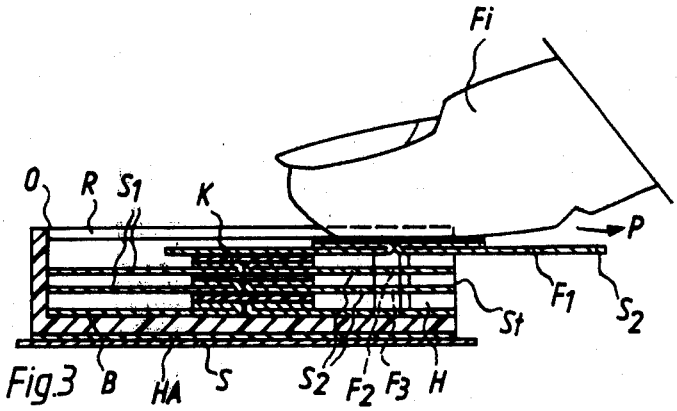
FIG. 3 is a longitudinal section of FIG. 1.

Referring to the embodiment in FIGS. 1–3, it will be seen that the novel dispenser package illustrated therein has a container which is advantageously of one piece, and which accommodates a stack of adhesive film splices K each of which is provided with a surrounding cover in form of protective papers S1 and S2. The papers S1 and S2 are folded in known manner and each cover one half of the transparent film splice K with which they form an assembly. It is emphasized that for the sake of clarity of illustration, only three such assemblies V2 and V3 are shown accommodated in the container and a fourth assembly V1 is shown partially withdrawn from the container; in actual fact, however, the film splices K and their associated protective paper layers S1 and S2 are so thin that if their thickness were to be properly illustrated to scale with respect to the space available in the illustrated container, the container would have to accommodate a stack of approximately 20 of these assemblies.

The other wall O of the container is adjacent the upper end of the stack of assemblies, and there is provided at it a frame R which holds down the stack in the region of the longitudinal lateral sides thereof, holding it down in direction towards the bottom wall B of the container. The end wall S*t* of the container is open. The papers S2 associated with the respective assemblies V are provided with lateral projections F, and the width of the container, of course, corresponds to the width of the assemblies including the lateral projections F.

The width of the opening in end wall S*t* corresponds to the width of the assemblies V, except that it is constricted by abutments H which are inclined towards the interior of the container so that the projections F2, F3 of the assemblies V2 and V3 that are located inside the container, engage the abutments H so that these assemblies are prevented from slipping out through the opening of the end wall S*t*. This prevents undesired and unintentional dispensing.

The assemblies V are relatively smooth both on their upper side and on their lower side. Therefore, when a finger F*i* of a user is placed through the uper opening in the wall O of the container into the upper side of the uppermost assembly in the stack, here the assembly V1, and pull is exerted in the direction of the arrow P, only the uppermost assembly V1 is displaced in the direction of the arrow P through the opening in the end wall S*t*. For this concept to operate properly, the friction between the finger F*i* and the upper side of the assembly V which it engages, here the assembly V1, must be greater than the friction between the upper side of the next subjacent assembly V2 and the underside of the assembly V1. If this is not inherently the case, then the upper side of each assembly may be provided with a coating of an appropriate material which will have a higher coefficient of friction with the finger F*i* than with the respective assemblies V. A suitable material for assemblies is oiled or waxed paper or paper coated with plastics.

The inward inclination of the abutments H serves to deflect the projections F1 on the protective paper S2 of the assembly V that is being withdrawn, here the assembly V1, so that they move out of the way and permit the assembly V1 to be withdrawn through the opening in the end wall S*t*. However, for this deflection of the projections F1 to take place, it is necessary that pull be exerted by the finger F*i* in the direction of the arrow P; mere movement of the container to a position in which the opening in the end wall S*t* is downwardly inclined, would not be sufficient to cause such deflection so that unintentional falling out of the assemblies V is reliably prevented.

It is advantageous if the container can be fixed at or near location where it is required to be used, for instance, on a film press which is to hold the ends of the film strips that are to be connected by means of the film splices in the assemblies V. In the illustrated embodiment, the container is provided for this purpose on its underside with an adhesive layer HA which is covered by a layer of release paper S that can be peeled off when the container is to be affixed to the film press. When this is done, it is then merely necessary for a user to employ the thumb and index finger of one hand to remove the respective assemblies V from the container.

Figure 4:
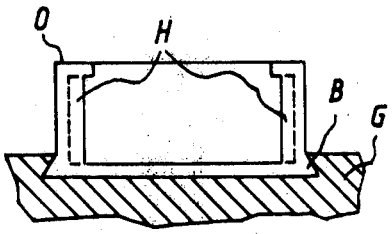
FIG. 4 is an end view, partly in section, illustrating a further embodiment of the invention.
Figure 5:
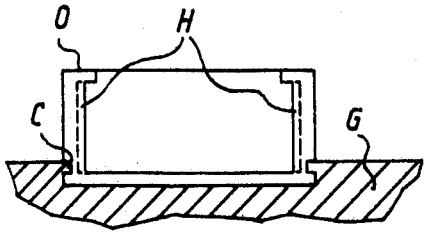
FIG. 5 is a view similar to FIG. 4 illustrating a modification.

FIG. 4 shows a further embodiment of the invention, wherein a layer H*a* is omitted but instead the side walls of the container are provided with projections B or, in the case of FIG. 5, with recesses C, which cooperate with corresponding recesses (in FIG. 4) or projections (in FIG. 5) in the support to which the container is to be affixed, here the housing G of a film press. In the case of FIGS. 4 and 5, it is a very simple matter to detach (by snapping out or the like) the container from the housing G when its contents have been removed, and replace it with a new container filled with assemblies V.

The filling of the containers with assemblies V during manufacture is effected by inserting a stack of the assemblies V into the container from the top, and can be accomplished readily and in simple manner by way of appropriate machinery.

It will be understood that each of the elements described above, or two or more together, may also find a useful application in other types of constructions differing from the type described above.

While the invention has been illustrated and described as embodied in a dispensing package for film splices, it is not intended to be limited to the details shown since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A dispenser package, comprising a container having an end wall; a stack of objects in said container and each having a predetermined width, said objects being assemblies that are each composed of an adhesive film splice and at least one protective cover layer on said film splice; an opening in said end wall of a width corresponding to said predetermined width, so as to permit withdrawal of said objects from said container; an abutment on said container in the region of said opening; and an abutment portion on each object and adapted to engage said abutment and to flex out of the way when requisite withdrawing force is exerted upon the object.

2. A dispenser package as defined in claim 1; and further comprising means on said container for mounting the same at a location where the objects to be dispensed are required.

3. A dispenser package as defined in claim 2, said container having a plurality of outside surfaces; and wherein said means for mounting comprises an adhesive layer on at least one of said surfaces, and a peel-off release paper covering said adhesive layer until the time of use.

4. A dispenser package as defined in claim 2, wherein means for mounting comprises portions adapted to engage with cooperation portions at a location where said container is to be mounted.

5. A dispenser package as defined in claim 1, wherein said cover layer has laterally projecting parts, and said container has abutment parts at respective lateral sides of said opening for engagement by said projecting parts so as to prevent said assemblies from freely sliding out of said opening.

6. A dispenser package as defined in claim 1, wherein use each assembly has an upper side and a lower side which faces the respectively subjacent assembly; and wherein said lower sides are each provided with a layer of a material which has a lesser coefficient of friction with the upper side of the subjacent assembly than said upper sides have with an instrumentality which engages them to withdraw the respective assembly from said container.

* * * * *